US005216776A

United States Patent [19]

Dennison

[11] Patent Number: 5,216,776

[45] Date of Patent: Jun. 8, 1993

[54] AUTOMATIC BLACKBOARD ERASER APPARATUS

[76] Inventor: Daniel C. Dennison, 2723 Hartmetz Ave., Evansville, Ind. 47712

[21] Appl. No.: 826,042

[22] Filed: Jan. 27, 1992

[51] Int. Cl.[5] ..... A47L 11/38; A43L 21/00

[52] U.S. Cl. ..... 15/312.1; 15/98; 15/77; 15/49.1; 15/319; 15/340.3

[58] Field of Search ..... 15/52.1, 98, 103, 250.22, 15/250.29, 312.1, 97.1, 77, 49.1, 319, 340.3, 340.4, 3.53

[56] References Cited

U.S. PATENT DOCUMENTS

| | | | |
|---|---|---|---|
| 1,561,320 | 11/1925 | Glidric et al. | 15/250.29 |
| 2,167,296 | 7/1939 | Farmer | 15/98 |
| 2,944,276 | 7/1960 | Presser | 15/250.29 |
| 3,163,943 | 1/1965 | Bell | 15/98 |
| 3,731,335 | 5/1973 | Chrisp | 15/97.1 |
| 3,858,265 | 1/1975 | Schlick | 15/319 |

FOREIGN PATENT DOCUMENTS

| | | | |
|---|---|---|---|
| 184461 | 1/1956 | Austria | 15/250.21 |
| 1059272 | 7/1979 | Canada | 15/98 |
| 0282151 | 12/1986 | Japan | 15/250.29 |

*Primary Examiner*—Harvey C. Hornsby
*Assistant Examiner*—Gary K. Graham
*Attorney, Agent, or Firm*—Leon Gilden

[57] ABSTRACT

An eraser includes a track structure to permit reciprocation of an eraser housing laterally of an elongate blackboard plate. The eraser housing includes a drive motor to effect rotation of a drive brush positioned above the blackboard plate, including a dust collection housing and tension roller positioned below the brush housing.

1 Claim, 4 Drawing Sheets

AUTOMATIC BLACKBOARD ERASER APPARATUS

BACKGROUND OF THE INVENTION

1. Field of the Invention

The field of invention relates to blackboard eraser structure, and more particularly pertains to a new and improved blackboard eraser apparatus wherein the same is arranged for automatic reciprocation relative to a blackboard plate.

2. Description of the Prior Art

Blackboard eraser structure of various types are utilized throughout the prior art to effect ease of cleaning of a blackboard structure. Such apparatus is exemplified in U.S. Pat. No. 3,858,265 to Shlick setting forth an eraser housing arranged for reciprocation relative to a blackboard structure.

U.S. Pat. No. 4,007,509 to Odhner sets forth a typical prior art manual blackboard eraser structure, wherein U.S. Pat. No. 4,462,134 to Wang sets forth a blackboard eraser wherein the same utilizes erasing rollers pivotally mounted within a base housing.

As such, it may be appreciated that there continues to be a need for a new and improved automatic blackboard eraser apparatus as set forth by the instant invention which addresses both the problems of ease of use as well as effectiveness in construction in the removal of accumulated blackboard eraser dust relative to a blackboard plate surface and in this respect, the present invention substantially fulfills this need.

SUMMARY OF THE INVENTION

In view of the foregoing disadvantages inherent in the known types of blackboard eraser apparatus now present in the prior art, the present invention provides an automatic blackboard eraser apparatus where the same permits ease of reciprocation and operation of a blackboard eraser housing relative to an associated blackboard. As such, the general purpose of the present invention, which will be described subsequently in greater detail, is to provide a new and improved automatic blackboard eraser apparatus which has all the advantages of the prior art blackboard eraser apparatus and none of the disadvantages.

To attain this, the present invention provides an eraser including a track structure to permit reciprocation of an eraser housing laterally of an elongate blackboard plate. The eraser housing includes a drive motor to effect rotation of a drive brush positioned above the blackboard plate, including a dust collection housing and tension roller positioned below the brush housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automatic blackboard eraser apparatus which has all the advantages of the prior art blackboard eraser apparatus and none of the disadvantages.

It is another object of the present invention to provide a new and improved automatic blackboard eraser apparatus which may be easily and efficiently manufactured and marketed.

It is a further object of the present invention to provide a new and improved automatic blackboard eraser apparatus which is of a durable and reliable construction.

An even further object of the present invention is to provide a new and improved automatic blackboard eraser apparatus which is susceptible of a low cost of manufacture with regard to both materials and labor, and which accordingly is then susceptible of low prices of sale to the consuming public, thereby making such automatic blackboard eraser apparatus economically available to the buying public.

Still yet another object of the present invention is to provide a new and improved automatic blackboard eraser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
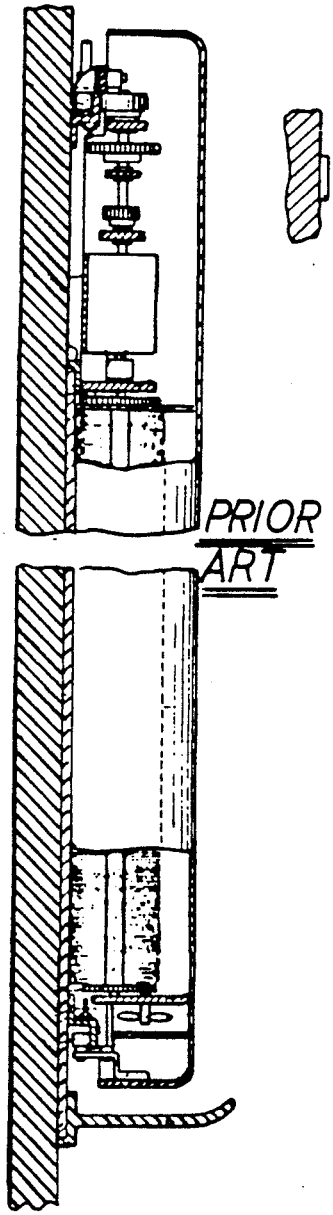
FIG. 1 is an orthographic side view, partially in section, of a prior art blackboard eraser structure.

With reference now to the drawings, and in particular to FIGS. 1 to 9 thereof, a new and improved automatic blackboard eraser apparatus embodying the principles and concepts of the present invention and generally designated by the reference numeral 10 will be described.

Figure 2:
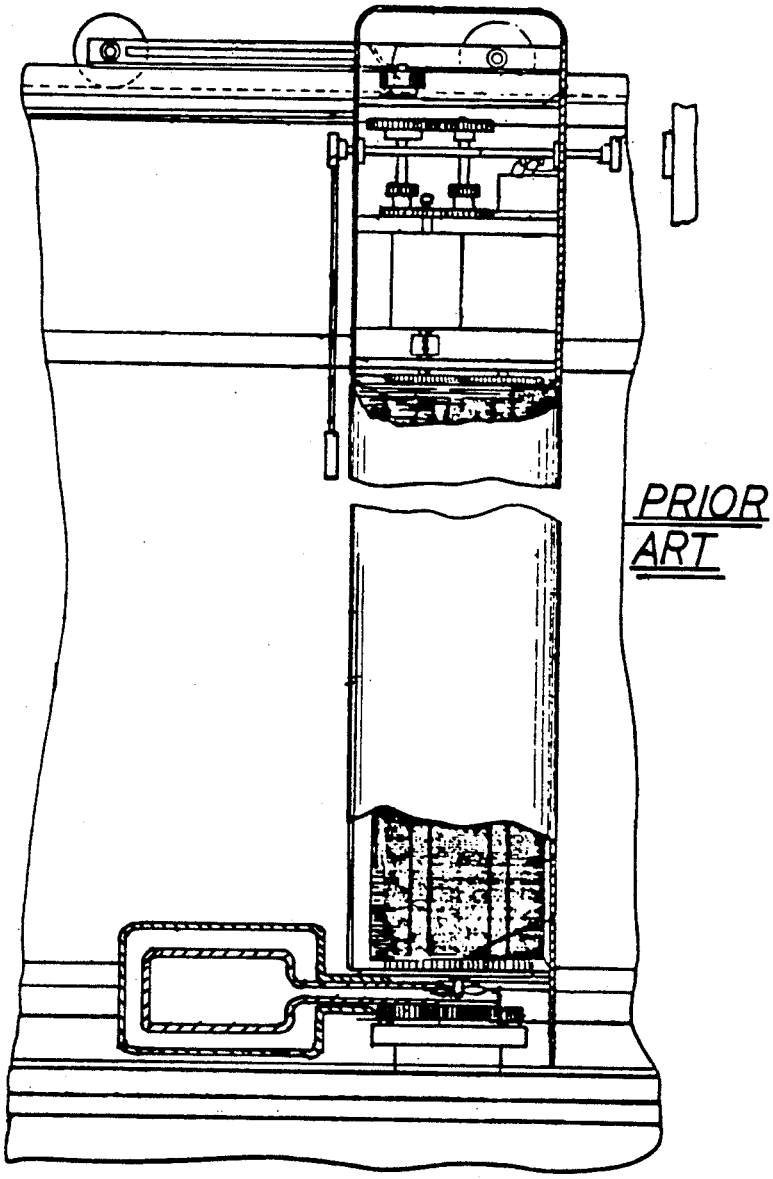
FIG. 2 is an orthographic frontal view, taken in elevation and partially in section, of the prior art blackboard eraser structure as set forth in FIG. 1.
Figure 3:
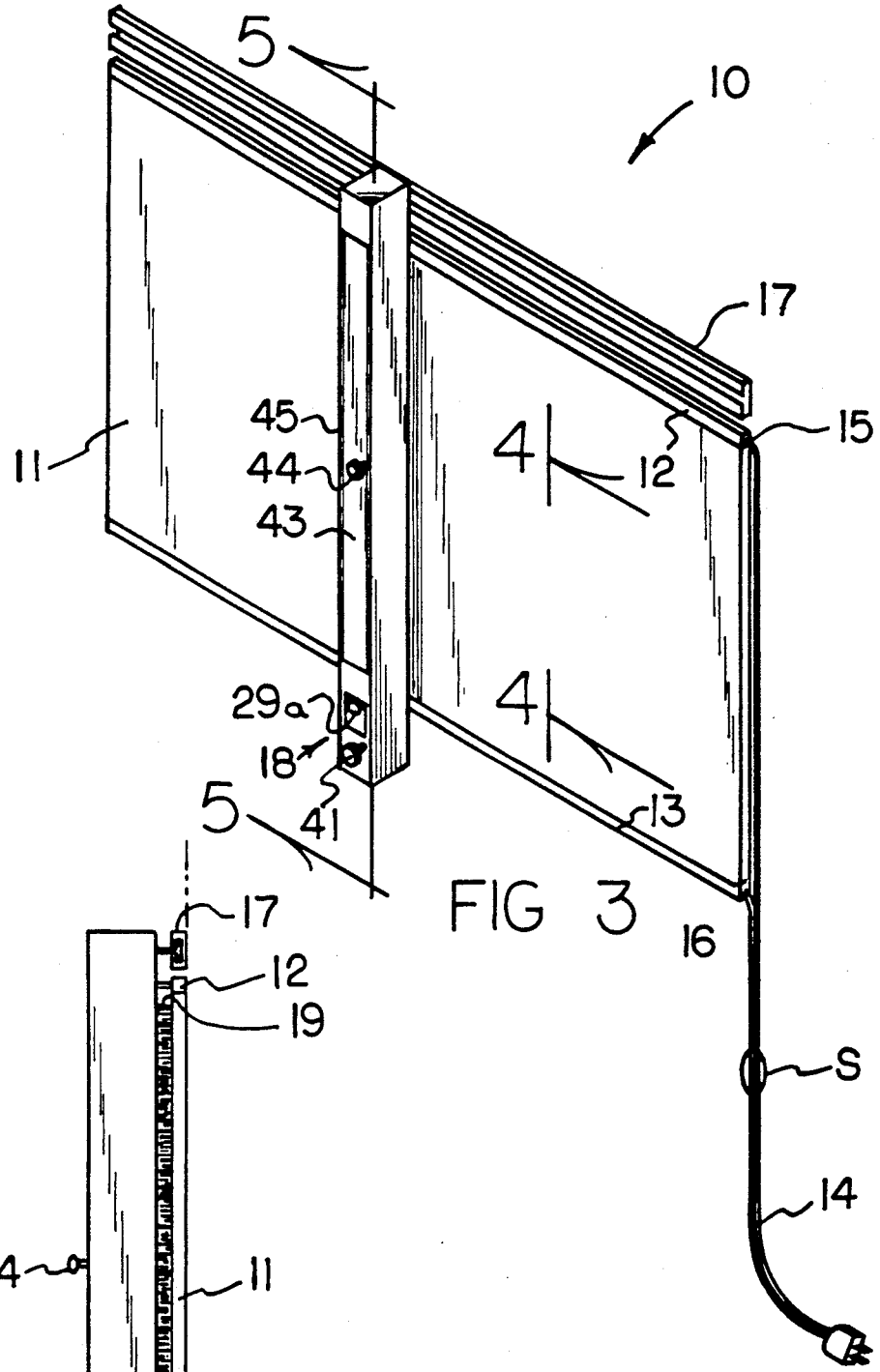
FIG. 3 is an isometric illustration of the instant invention.
Figure 4:
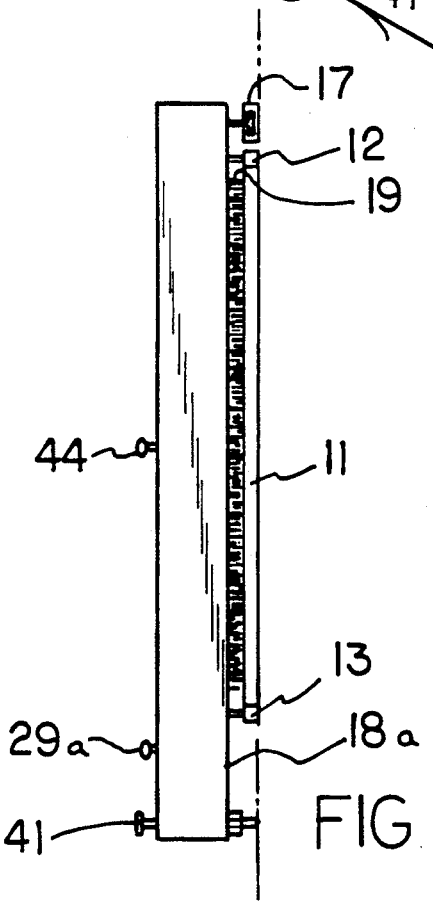
FIG. 4 is an orthographic view, taken along the lines 4—4 of FIG. 3 in the direction indicated by the arrows.
Figure 5:
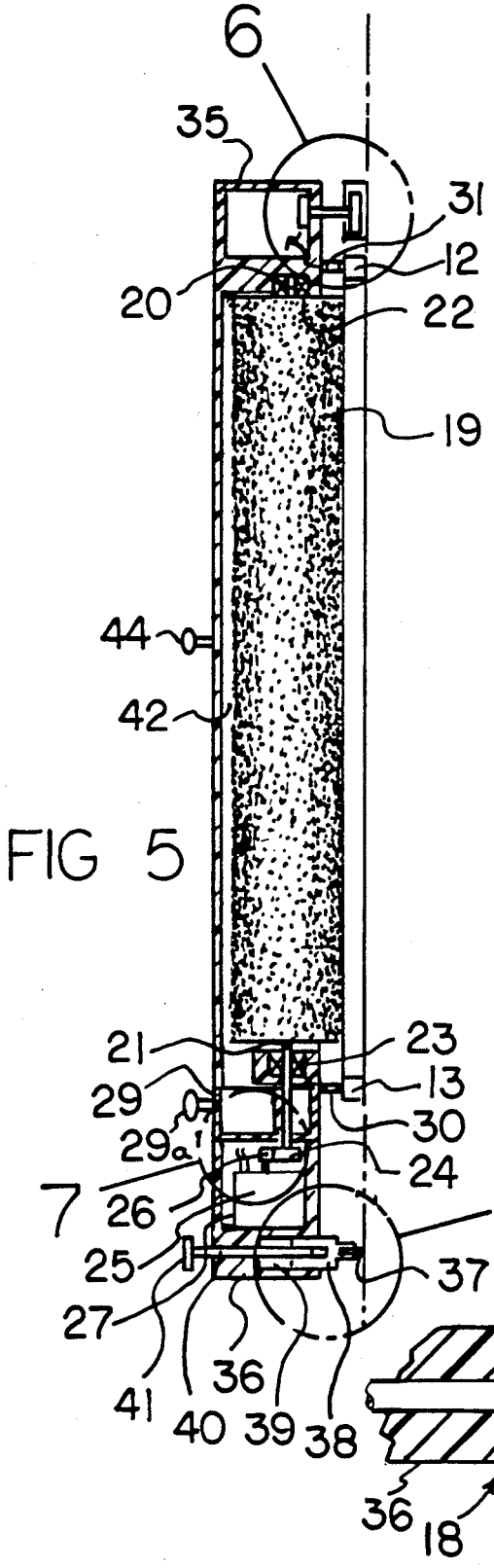
FIG. 5 is an orthographic view, taken along the lines 5—5 of FIG. 3 in the direction indicated by the arrows.
Figure 6:
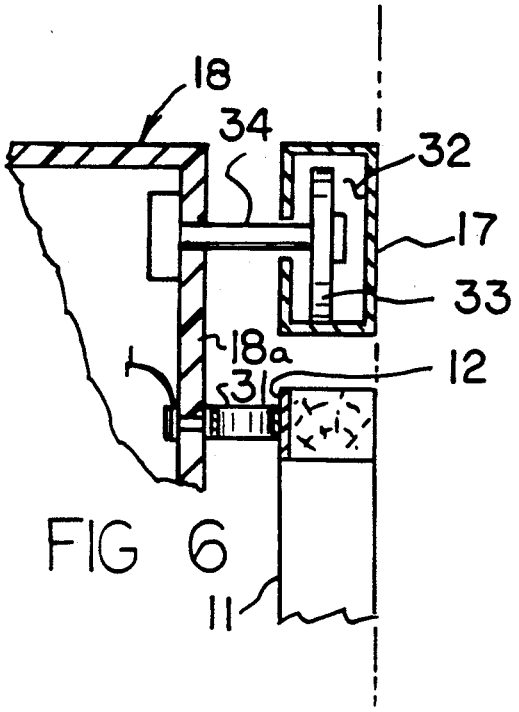
FIG. 6 is an orthographic view, taken of section 6, as set forth in FIG. 5.
Figure 7:
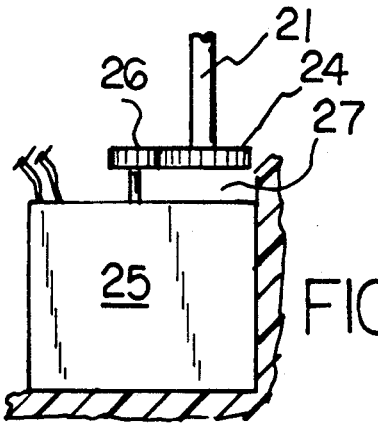
FIG. 7 is an orthographic view of section 7, as set forth in FIG. 5.
Figure 8:
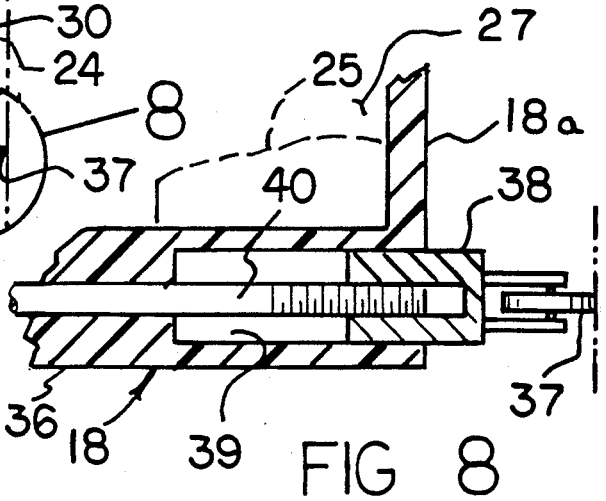
FIG. 8 is an orthographic view of section 8, as set forth in FIG. 5.

The FIGS. 1 and 2 illustrate a prior art automatic blackboard eraser structure, as set forth in the U.S. Pat No. 3,858,265 wherein the housing is arranged mounted to upper and lower tracks for reciprocation relative to a blackboard surface.

More specifically, the automatic blackboard apparatus 10 of the instant invention essentially comprises a blackboard plate 11 available in various colorations and the like and formed with an upper metallic strip 12 spaced and parallel a lower metallic strip 13 on opposed upper and lower sides of the blackboard plate 11. An electrical transmission line 14 to be formed with an on/off switch "S" of a convenient configuration includes a first transmission line connection 15 directed into the upper metallic strip 12 and a second transmission line connection 16 in electrical communication with the lower metallic strip 13 to provide for upper and lower contacts along the upper and lower metallic strips 12 and 13. A guide track 17 is positioned above and adjacent the upper metallic strip 12 in a parallel coextensive relationship relative to the upper metallic strip 12. An eraser housing 18 mounted to the guide track 17 at an upper end portion of the housing 18 is reciprocatably mounted relative to the blackboard plate 11, and more specifically to a top surface thereof guided along the guide track 17. A rotary cylindrical brush 19 is positioned within the eraser housing 18 and includes an axle upper end 20 contained within an upper bearing 22 and an axle lower end 21 coaxially aligned with the axle upper end 20 directed through a lower bearing 23 and projecting beyond the lower bearing 23 terminating with an axle lower end gear 24 in operative communication with a drive motor gear 26. The drive motor gear 26 is rotatably mounted relative to a reversible drive motor 25 that receives electrical energy from the upper and lower metallic strips 12 and 13 upon actuation of the switch "S". The housing 17 includes the drive motor 25 positioned within a drive motor chamber 27 in a lower end portion of the housing 17, with a dust accumulation chamber 28 positioned adjacent to and above the drive motor chamber 27. The dust accumulation chamber 28 includes a chamber door 29, including a first handle 29*a* for access into the chamber 28 for its maintenance and cleaning. A lower strip spring contact 30 in electrical communication with the drive motor 25 and the lower metallic strip 13 is directed through a bottom wall 18*a* of the housing 18, with an upper strip spring contact 31 in electrical communication with the upper metallic strip 12 in electrical communication with the upper metallic strip 12 and the drive motor 25. A guide track chamber 32 of longitudinal configuration is positioned within the guide track 17, with a track chamber wheel 33 rotatably mounted within the track chamber 32. An axle 34 rotatably mounts the track chamber wheel 33, with the axle 34 orthogonally mounted to the bottom wall 18*a* adjacent a housing top end wall 35 spaced from a housing bottom end wall 36. The housing bottom end wall 36 includes positioning of a lower guide wheel 37 (see FIG. 8) relative thereto as the lower guide wheel 37 projects beyond the housing bottom wall 18*a* and rotatably mounted within a guide wheel support 38 that in turn is reciprocatably mounted within a wheel support socket 39 directed into the housing through bottom wall 18*a*. The wheel support socket 39 is orthogonally oriented relative to the bottom wall 18*a*, with the socket including a threaded rod 40 threadedly received within the wheel support 38 to effect reciprocation of the wheel support 38 upon rotation of the threaded rod 40 by a threaded rod handle 41 projecting through a top wall of the housing 18. The cylindrical brush chamber 42 positioned adjacent the drive motor chamber 27 and thereabove includes a chamber door 43 directed through the top wall of the housing for access to the cylindrical brush for its maintenance and cleaning. The cylindrical brush chamber door includes a brush chamber door handle 44 for ease of opening of the brush chamber door 43 about the brush chamber door hinge 45.

Figure 9:
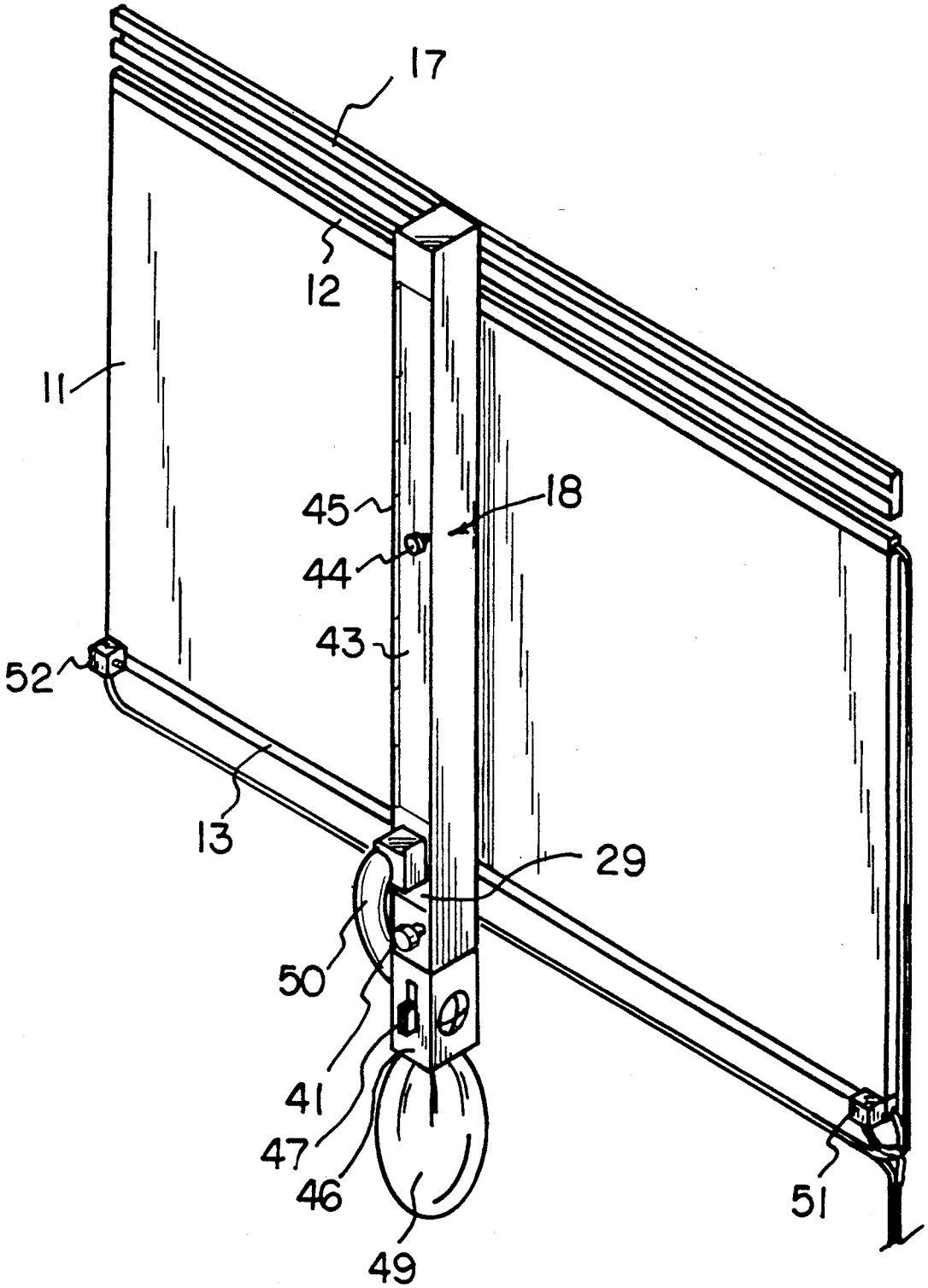
FIG. 9 is an isometric illustration of the housing structure utilizing a vacuum housing attachment thereto.

The FIG. 9 illustrates the use of a vacuum housing 46 mounted to the housing bottom end wall 36, with the vacuum housing including a vacuum housing switch 47 for effecting selective actuation of the vacuum within the vacuum housing 46. A collector bag 49 is arranged for suspension below and in communication with the vacuum housing 46, with a collector bag hose 50 directed from the collector bag 49 through the brush accumulation chamber door 29 into the dust accumulation chamber 28. Further, the FIG. 9 illustrates the use of respective first and second limit switches 51 and 52 positioned adjacent the lower metallic strip 13 to effect selective reversal of the reversing motor 25 upon engagement with respective first and second limit switches 51 and 52 to simultaneously effect cleaning of the entire top surface of the blackboard plate 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic blackboard eraser apparatus, comprising, a blackboard plate, the blackboard plate including a plate upper edge and a plate lower edge, the plate upper edge and plate lower edge are arranged in a spaced parallel relationship, the plate upper edge including an upper metallic strip continuous with and coextensive with the plate upper edge, and a plate lower metallic strip contiguous and coextensive with the plate lower edge, the upper metallic strip arranged in a parallel relationship relative to the lower metallic strip, and an electrical transmission line, the electrical transmission line including a first transmission line connection directed into the upper metallic strip, and a second transmission line connection directed into the lower metallic strip, the electrical transmission line including an on/off switch, and a guide track spaced from and parallel the upper metallic strip coextensive therewith, and an eraser housing mounted to the guide track and the eraser housing including a rotary cylindrical brush contained within the eraser housing, the rotary cylindrical brush extending between the plate upper edge and the plate lower edge, and the rotary cylindrical brush including a reversal drive motor means arranged for effecting selective rotation of the rotary cylindrical brush, with the rotary cylindrical brush in contiguous communication with a blackboard plate top surface, and the drive motor means in electrical communication with the upper metallic strip and the lower metallic strip for directing electrical energy into the drive motor means, and the eraser housing includes a housing bottom wall, the housing bottom wall including a lower strip spring contact in electrical communication with the drive motor and the lower metallic strip, and an upper strip spring contact directed through the housing bottom wall in electrical communication with the drive motor and the upper metallic strip, and the eraser housing includes a top end wall spaced from a bottom end wall, the bottom end wall including a wheel support socket projecting orthogonally relative to the bottom wall and adjacent the bottom end wall, with the wheel support socket reciprocatably mounting a guide wall support therewithin, and the guide wall support rotatably mounting a lower guide wheel projecting beyond the housing bottom wall for rotative mounting below the lower metallic strip and support of the eraser housing, and a threaded rod directed orthogonally through the eraser housing received within the guide wall support, whereupon rotation of the threaded rod effects reciprocation of the guide wall support within the wheel support socket, and a drive motor chamber positioned adjacent the wheel support socket, the drive motor chamber mounting the drive motor means therewithin, the drive motor means including a reversible drive motor, with the reversal drive motor including a drive motor gear, the drive motor gear in mechanical communication with an axle lower end gear, and the rotary cylindrical brush including an axle upper end projecting through an upper end portion of the rotary cylindrical brush received within an upper bearing and an axle lower end coaxially aligned with the axle upper end directed through a lower end portion of the rotary cylindrical brush received within a lower bearing, the axle lower end directed through the lower bearing and terminating and orthogonally mounted to the axle lower end gear, and the rotary cylindrical brush is contained within a brush chamber within the eraser housing positioned adjacent to the motor chamber, and a dust accumulation chamber is provided and oriented between the brush chamber and the drive motor, the dust accumulation chamber in communication with the brush chamber, and the dust accumulation chamber having a dust accumulation chamber door directed through the eraser housing, and the guide track includes a guide track chamber coextensive with the guide track, and the housing bottom wall includes a guide wheel axle orthogonally mounted to the housing bottom wall adjacent the housing top end wall, and the housing guide wall axle includes a track chamber wheel rotatably mounted to a free distal end of the guide wheel axle, with the track chamber wheel received within the guide track chamber, and a vacuum housing mounted to the eraser housing bottom end wall, the vacuum housing including a vacuum housing switch for effecting selective actuation of a vacuum means contained within the vacuum housing, and a collector bag suspended below the vacuum housing, with the collector bag including a collector bag hose directed from the collector bag through the dust accumulation chamber door into the dust accumulation chamber.

* * * * *